US010399366B2

(12) United States Patent
Sakaguchi

(10) Patent No.: US 10,399,366 B2
(45) **Date of Patent: *Sep. 3, 2019**

(54) RECORDING APPARATUS

(71) Applicant: BROTHER KOGYO KABUSHIKI KAISHA, Nagoya-shi, Aichi-ken (JP)

(72) Inventor: Shintaro Sakaguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/671,542

(22) Filed: Aug. 8, 2017

(65) Prior Publication Data

US 2018/0079236 A1 Mar. 22, 2018

Related U.S. Application Data

(63) Continuation of application No. 15/271,659, filed on Sep. 21, 2016, now Pat. No. 9,757,964.

(30) Foreign Application Priority Data

Sep. 29, 2015 (JP) ..... 2015-190853

(51) Int. Cl.
*B41J 2/01* (2006.01)
*B41J 3/60* (2006.01)
(Continued)

(52) U.S. Cl.
CPC ..... *B41J 13/0054* (2013.01); *B41J 2/01* (2013.01); *B41J 3/60* (2013.01); *B41J 11/002* (2013.01);
(Continued)

(58) Field of Classification Search
CPC ..... B41J 3/60
See application file for complete search history.

(56) References Cited

U.S. PATENT DOCUMENTS 8,911,050 B2 12/2014 Nishihara
2005/0073535 A1 4/2005 Seki et al.
(Continued)

FOREIGN PATENT DOCUMENTS

JP 2007054999 A 3/2007
JP 2010275085 A 12/2010
(Continued)

OTHER PUBLICATIONS

Notice of Allowance dated May 12, 2017 from related U.S. Appl. No. 15/271,659, filed Sep. 21, 2016.
(Continued)

*Primary Examiner* — Julian D Huffman
(74) *Attorney, Agent, or Firm* — Scully, Scott, Murphy & Presser, PC

(57) ABSTRACT

There is provided a recording apparatus including a liquid jetting unit, a container unit, a receiving unit, a conveyance unit and a controller. The controller is configured to carry out: determining whether or not it is necessary to stop and dry the liquid jetted recording medium in the conveyance path and controlling the conveyance unit to stop the recording medium in the conveyance path under a condition that the controller determines that it is necessary to dry the recording medium.

27 Claims, 9 Drawing Sheets

(51) Int. Cl.
*B41J 11/00* (2006.01)
*B41J 13/00* (2006.01)

(52) U.S. Cl.
CPC ..... *B41J 13/0009* (2013.01); *B41J 13/0036* (2013.01); *B41J 13/0045* (2013.01)

(56) References Cited

U.S. PATENT DOCUMENTS

| | | | | |
|---|---|---|---|---|
| 2008/0204497 | A1 | 8/2008 | Furuhata | |
| 2009/0102908 | A1 | 4/2009 | Imoto | |
| 2010/0302298 | A1 | 12/2010 | Moriyama et al. | |
| 2015/0103112 | A1* | 4/2015 | Lo | B41J 3/60 347/16 |

FOREIGN PATENT DOCUMENTS

| | | | |
|---|---|---|---|
| JP | 2011-073323 | A | 4/2011 |
| JP | 2014-080011 | A | 5/2014 |

OTHER PUBLICATIONS

Official Action dated Jun. 11, 2019 received from the Japanese Patent Office in related JP 2015-190853 together with English language translation.

* cited by examiner

RECORDING APPARATUS

CROSS REFERENCE TO RELATED APPLICATION

The present application is a continuation application of U.S. Ser. No. 15/271,659 filed on Sep. 21, 2016 and claims priority from Japanese Patent Application No. 2015-190853, filed on Sep. 29, 2015, the disclosure of each of which are incorporated herein by reference in their entirety.

FIELD OF THE INVENTION

The present invention relates to recording apparatuses carrying out a recording operation by jetting a liquid onto a recording medium.

DESCRIPTION OF THE RELATED ART

Conventionally, such an operation is known that in order to prevent ink (liquid) from adhering to a discharge portion (receiving unit) or recording paper (a recording medium) placed in the discharge portion, the recording paper with the ink jetted thereon is discharged to the discharge portion after being caused to stand by (to stop) and dry on the inner side of guides (in a downstream path) provided on the downstream side from a recording head and on the upstream side from the discharge portion.

When the recording operation is carried out continuously on a plurality of recording media, when each of the recording media is stopped and dried in sequence in the downstream path, then it is possible for the throughput to decrease.

It is an object of the present invention to provide a recording apparatus capable of restraining the throughput from decreasing even when it is necessary to stop and dry the recording media with a liquid jetted thereon in a conveyance path, when a recording operation is carried out continuously on a plurality of recording media.

SUMMARY

According to an aspect of the present teaching, there is provided a recording apparatus configured to jet liquid onto a recording medium comprising:

a liquid jetting unit including a plurality of nozzles to jet the liquid;

a container unit configured to contain the recording medium to be fed to the liquid jetting unit;

a receiving unit configured to receive the recording medium on which the liquid has been jetted by the liquid jetting unit;

a conveyance unit configured to convey the recording medium from the container unit to the receiving unit via a facing position facing the plurality of nozzles; and a controller configured to control the conveyance unit and the liquid jetting unit, wherein inside the recording apparatus, a conveyance path is defined to include an upstream path from the container unit to the facing position, a downstream path from the facing position to the receiving unit, and a switchback path diverging from the downstream path and returning to the upstream path or the downstream path;

wherein the conveyance unit is configured to convey the recording medium along the conveyance path;

wherein the controller is configured to carry out:

determining whether or not it is necessary to stop and dry the liquid jetted recording medium in the conveyance path under a condition that the recording is carried out continuously on the recording medium including a plurality of media, and controlling the conveyance unit to stop the recording medium in the conveyance path under a condition that the controller determines that it is necessary to dry the recording medium; and wherein in a case of controlling the conveyance unit to stop the recording medium in the conveyance path, the controller is configured to carry out:

transporting one recording medium, of the recording media, which is conveyed from the upstream path to the downstream path and on which the recording is carried out at the facing position, to the switchback path by reversing a conveyance direction which is the direction for the conveyance unit to transport the recording medium, and then stopping the one recording medium in a state of being at least partially within the switchback path, and stopping another recording medium, of the recording media, in a state that the another recording medium is at least partially within the downstream path while the one recording medium is stopping in the state of being at least partially within the switchback path, where the another recording medium is different from the one recording medium, is conveyed from the upstream path to the downstream path, and is finished with the recording at the facing position.

According to the present teaching, when the recording is carried out continuously on a plurality of recording media, even when it is necessary to stop and dry the liquid jetted recording media in the conveyance path, each recording medium is not stopped in order in the same place, but the plurality of recording media (the one recording medium and the other recording medium mentioned above) are stopped simultaneously in the switchback path and the downstream path respectively. By virtue of this, it is possible to reduce the total stopping and drying time during the recording, thereby restraining the throughput from decreasing.

DESCRIPTION OF THE EMBODIMENTS

Figure 1:
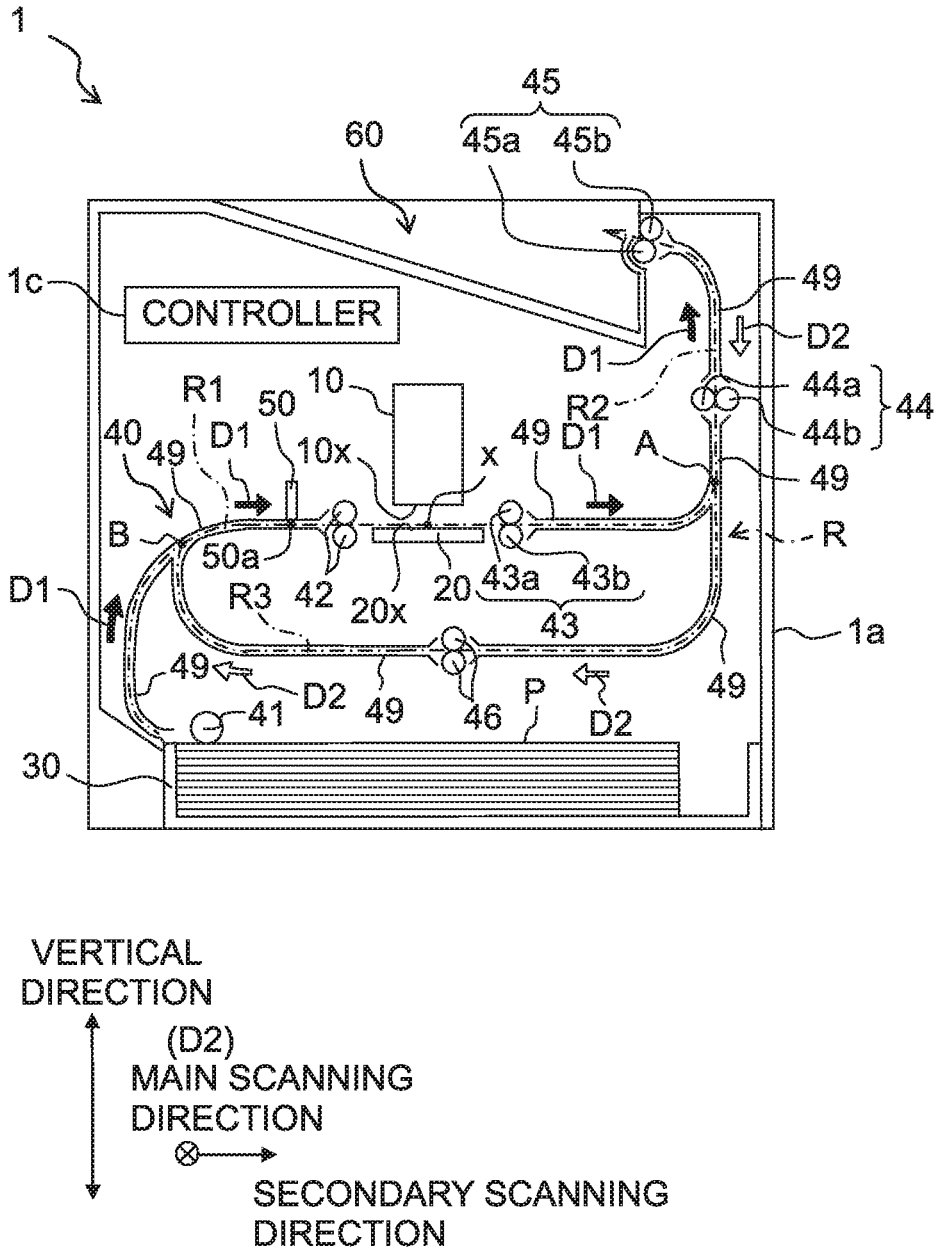
FIG. 1 is a schematic lateral view of the inside of an ink jet printer according to an embodiment of the present invention.

As depicted in FIG. 1, an ink jet printer 1 (to be referred to simply as "printer 1", hereinbelow) according to one embodiment of the present teaching has a case 1*a*. The case 1*a* contains, in its inner space, an ink jet head 10 (to be referred to simply as "head 10", hereinbelow), a platen 20, a paper feed tray 30, a conveyance unit 40, a paper sensor 50, and a controller 1*c*. A receiving unit 60 is provided in an upper part over a top board of the case 1*a*.

Figure 2:
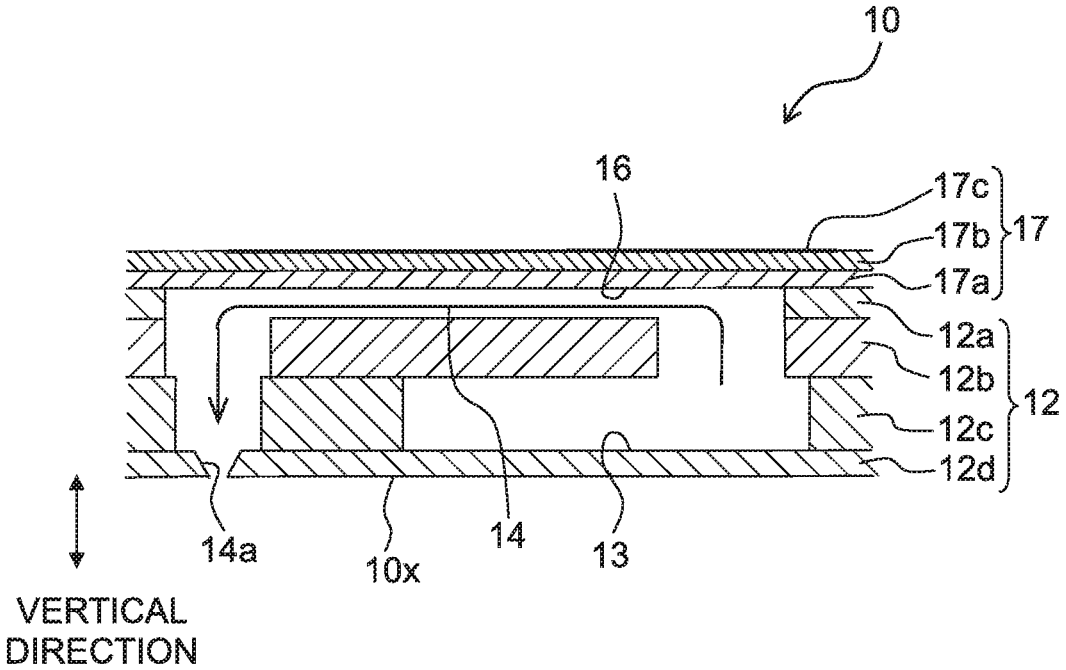
FIG. 2 is a partial cross-sectional view of an ink jet head included in the ink jet printer of FIG. 1.

The head 10 corresponds to the "liquid jetting unit" of the present teaching. The head 10 of this embodiment is a line head elongated in a main scanning direction and, as depicted in FIG. 2, includes a channel unit 12 and an actuator unit 17.

The channel unit 12 is a layered body formed by layering plates 12*a* to 12*d*. A channel is formed inside the channel unit 12. The lower surface of the channel unit 12 serves as a jet surface 10*x* with a plurality of jet openings 14*a* formed to open thereon. The channel formed inside the channel unit 12 includes one manifold channel 13 and a plurality of individual channels 14. The individual channels 14 are each provided for one of the jet openings 14*a*, and extend from an exit of the manifold channel 13 to the jet openings 14*a* via pressure chambers 16. The manifold channel 13 is in communication with a tank (not depicted) retaining an ink. The ink supplied from the tank to the manifold channel 13 passes through the individual channels 14 to be jetted from the jet openings 14*a*.

The actuator unit 17 is another layered body formed by layering a vibration plate 17*a*, a piezoelectric layer 17*b*, and a plurality of individual electrodes 17*c*. The vibration plate 17*a* is fixed on the upper surface of the channel unit 12 to seal up the plurality of pressure chambers 16. The piezoelectric layer 17*b* is fixed on the upper surface of the vibration plate 17*a* to face the plurality of pressure chambers 16. The plurality of individual electrodes 17*c* are fixed on the upper surface of the piezoelectric layer 17*b* to respectively face the plurality of pressure chambers 16. Such a part of the actuator unit 17 as interposed between each of the individual electrodes 17*c* and the corresponding one of the pressure chambers 16 functions as an individual actuator of unimorph type for each of the pressure chambers 16. This actuator is capable of independent deformation in response to the application of a voltage to the individual electrodes 17*c*. With the actuator deformed to project toward the corresponding pressure chamber 16, the volume of that pressure chamber 16 decreases such that a pressure is applied to the ink inside the pressure chamber 16 and thus the ink is jetted from the corresponding jet opening 14*a*.

The platen 20 is formed of a flat plate, and arranged in a position facing the jet surface 10*x*. A predetermined interspace appropriate for recording is formed between the jet surface 10*x* and a surface 20*x* of the platen 20.

The paper feed tray 30 corresponds to the "container unit" of the present teaching, serving to contain recording paper or simply paper P to be fed to the head 10. The paper P corresponds to the "recording medium" of the present teaching. The paper feed tray 30 is capable of containing a plurality of sheets of the paper P as well as capable of containing the paper P in multi-type sizes, and is attachable to and removable from the case 1*a*.

The conveyance unit 40 is configured to transport the paper P along a conveyance path R from the paper feed tray 30 up to the receiving unit 60 via a facing position X facing the jet surface 10*x*. The conveyance path R includes an upstream path R1 from the paper feed tray 30 to the facing position X, a downstream path R2 from the facing position X to the receiving unit 60, and a switchback path R3 which diverges from the downstream path R2 and returns to the upstream path R1.

The switchback path R3 diverges from the downstream path R2 at a divergence position A prescribed in the downstream path R2, and merges into the upstream path R1 at a mergence position B prescribed in the upstream path R1. The switchback path R3 passes below the head 10 and platen 20, with the divergence position A as one end and with the mergence position B as the other end. At the divergence position A, a switch mechanism (not depicted) is arranged for switching the transportation of the paper P to either the path R2 or the path R3. At the mergence position B, another switch mechanism (not depicted) is arranged for switching the transportation of the paper P to either the path R1 or the path R3. Both of the switch mechanisms are controlled by the controller 1*c* to transport the paper P along the determined path.

The conveyance unit 40 includes a paper feed roller 41, roller pairs 42 to 46, and a plurality of guides 49.

Figure 3:
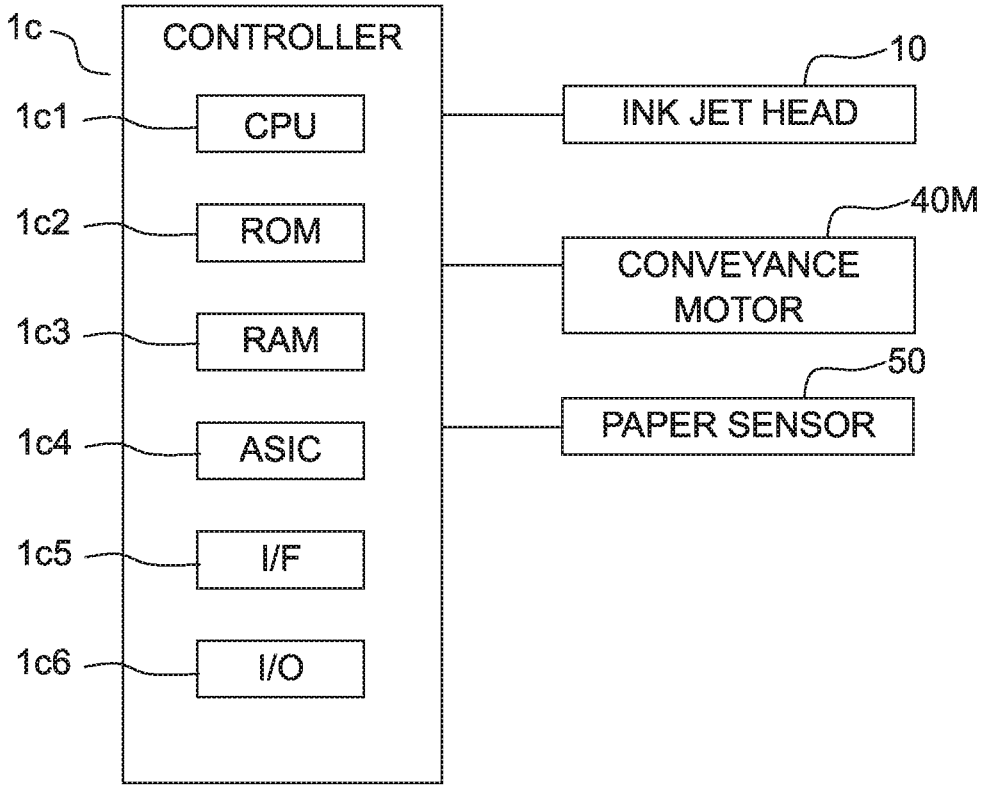
FIG. 3 is a block diagram showing an electrical configuration of the ink jet printer of FIG. 1.

The paper feed roller 41 is arranged in a position to contact with the uppermost sheet of the paper P in the paper feed tray 30. The paper feed roller 41 is caused to rotate by a conveyance motor 40M (see FIG. 3) being driven under the control of the controller 1*c*, to send out the uppermost sheet of the paper P in the paper feed tray 30.

The roller pairs 42 to 46 are arranged at predetermined intervals along the conveyance path R. Each of the roller pairs 42 to 46 is configured to include two rollers in contact with each other, to nip the paper P with those two rollers while conveying the paper P. One of the two rollers constituting each pair of the rollers 42 to 46 is a driving roller which is caused to rotate by the conveyance motor 40M (see FIG. 3) being driven under the control of the controller 1*c*. The other of the two rollers constituting each pair of the rollers 42 to 46 is a driven roller which rotates along with the rotation of the driving roller, in the reverse direction from the driving roller while in contact with the driving roller. The rotating roller pairs 42 to 46 transport, along the conveyance path R, the paper P sent out from the paper feed tray 30 by the paper feed roller 41.

The roller pairs 42, 43 and 46 are rotatable only in a forward direction (which is the direction D1 indicated with the black arrows in FIG. 1 for the roller pairs 42 and 43 to transport the paper P, but the direction D2 indicated with the outline arrows in FIG. 1 for the roller pair 46 to transport the paper P). The roller pairs 44 and 45 are rotatable in the forward and backward directions (the direction D1 of transporting the paper P and the direction D2 of transporting the paper P).

With respect to each pair of the rollers 43 to 45 arranged in the downstream path R2, one of rollers 43*a* to 45*a* (rollers in contact with the surface of the paper P on which the ink is jetted at the facing position X in the latest recording) is a spur roller having a plurality of projections on its outer circumference, while the other of rollers 43*b* to 45*b* is a rubber roller.

The roller pair 46 corresponds to the "conveyance member" of the present teaching, serving to contact with the paper P in the switchback path R3 to convey the paper P.

Each of the guides 49 includes a pair of plates arranged to face each other across an interspace, so as to form a space through which the paper P is conveyed along the conveyance path R.

The paper sensor 50 outputs, to the controller 1*c*, an ON signal when the paper P is present at a detection position 50*a* prescribed in the upstream path R1 or an OFF signal when the paper P is absent at the detection position 50*a*.

The receiving unit 60 is constructed from the top board of the case 1*a* in this embodiment, to receive the paper P conveyed thereto through the conveyance path R.

The controller 1*c* includes a CPU 1*c*1 (Central Processing Unit) which is a computation processing device, a ROM 1*c*2 (Read Only Memory), a RAM 1*c*3 (Random Access Memory), an ASIC 1*c* 4 (Application Specific Integrated Circuit), an OF 1*c*5 (Interface), and an I/O 1*c*6 (Input/Output Port). The ROM 1*c*2 stores fixed data such as programs and the like for the CPU 1*c*1 to execute. The RAM 1*c*3 temporarily stores data (image data and the like) needed for the CPU 1*c*1 to execute the programs. The ASIC 1*c*4 carries out processes of rewriting and sorting the image data, etc. (for example, signal processing and image processing). The OF 1*c*5 carries out data transmissions with an external device (for example, a PC connected to the printer 1). The I/O 1*c*6 carries out signal transmissions with various sensors including the paper sensor 50.

Next, referring to FIGS. 4 to 8, an explanation will be made on contents of the control carried out by the controller 1*c* (or by the CPU 1*c*1 in detail).

Further, in the following explanation, the term "recording command" refers to a command instructing a continuous recording to be carried out on a plurality of sheets of the paper P. The following explanation is related to a control of conveying the paper P when the continuous recording is carried out on the plurality of sheets of the paper P, whereas explanations will be omitted for the control of driving the head 10 and for the control of conveying the paper P when a recording is carried out on one sheet of the paper P. Further, although the switch mechanisms (not depicted) arranged at the divergence position A and the mergence position B are controlled in accordance with conveying the paper P, explanation will be omitted for the control of the switch mechanisms.

Figure 4:
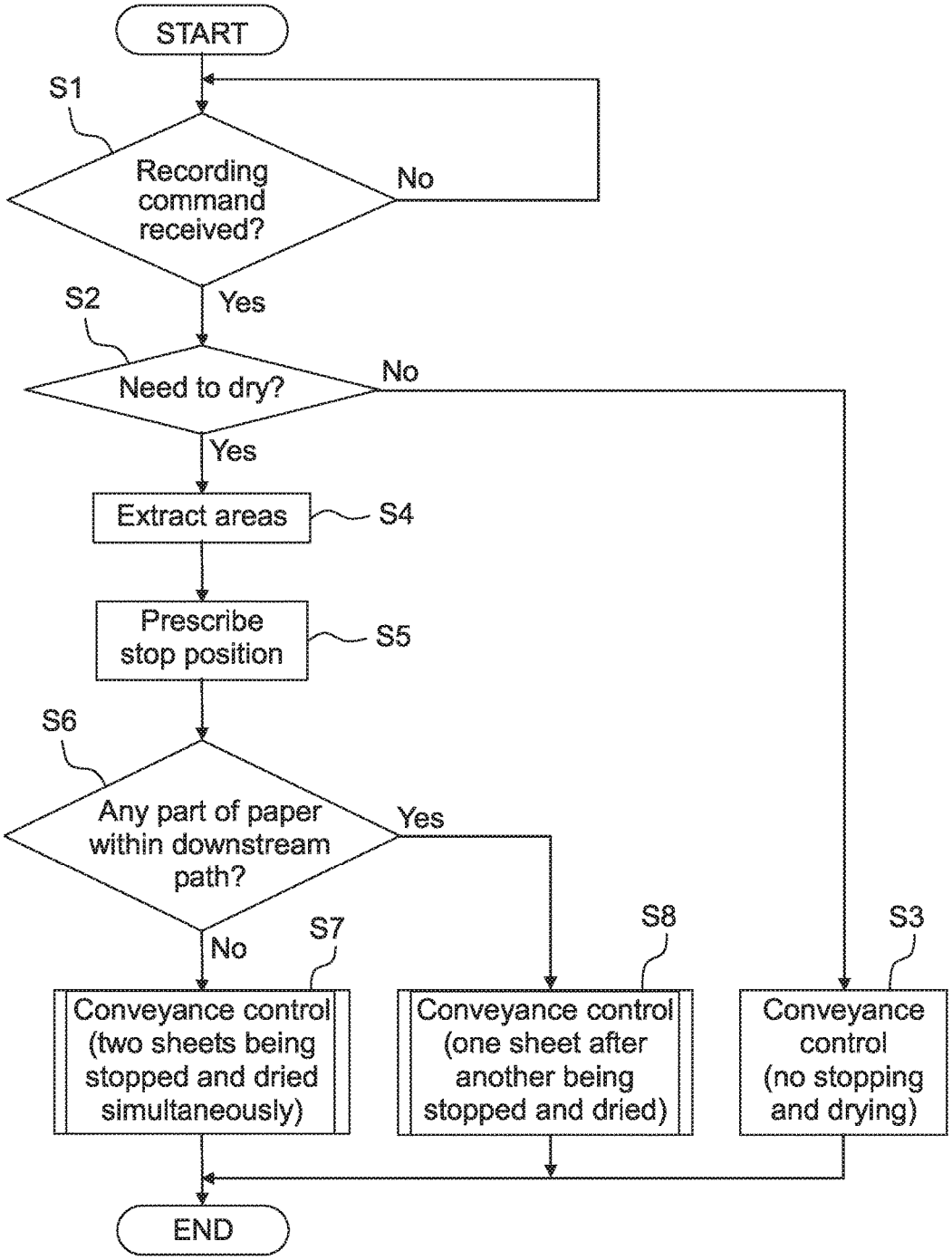
FIG. 4 is a flow diagram showing contents of a control carried out by a controller of the ink jet printer of FIG. 1.

As depicted in FIG. 4, the CPU 1*c*1 first determines whether or not the recording command is received from the external device (step S1). When it is determined that the recording command is not received (S1: No), then the CPU 1*c*1 repeats the process of step S1. Further, in the following explanation, step S1 may also be referred to simply as S1.

When it is determined that the recording command is received (S1: Yes), then the CPU 1*c*1 determines whether or not it is necessary to stop and dry, in the conveyance path R, each sheet of the paper P on which the recording should be carried out based on that recording command, after being recorded thereon (that is, after the ink is jetted thereon at the facing position X) but before being received by the receiving unit 60 (S2). The determination of S2 is carried out on the basis of, for example, the amount of the ink jetted on each sheet of the paper P, the type of the paper P, and the like.

When it is determined that it is not necessary to dry the paper P (S2: No), then the CPU 1*c*1 carries out "Conveyance control (no stopping and drying)" (S3). In S3, the CPU 1*c*1 controls the conveyance unit 40 such that each sheet of the paper P may not be stopped in the conveyance path R for being dried in between the paper feed tray 30 and the receiving unit 60.

In S3, in the case of a single side continuous recording (that is, a continuous recording on a plurality of sheets of the paper P, wherein each sheet has two surfaces: a first surface and a second surface on the other side of the first surface, and the continuous recording is on the first surface), the plurality of sheets of the paper P are conveyed in sequence from the paper feed tray 30 along the direction D1, pass through the upstream path R1, arrive at the facing position X and, after the recording is carried out on the first surfaces at the facing position X, pass through the downstream path R2 to be received by the receiving unit 60.

In S3, in the case of a both side continuous recording (that is, a continuous recording on a plurality of sheets of the paper P, wherein each sheet has two surfaces: a first surface and a second surface on the other side of the first surface, and the continuous recording is on both of the two surfaces), the plurality of sheets of the paper P are conveyed in sequence from the paper feed tray 30 along the direction D1, pass through the upstream path R1, arrive at the facing position X and, after the recording is carried out on the first surfaces at the facing position X, are conveyed into the downstream path R2 and stopped for a time in a state of being nipped by the roller pairs 44 and 45. Then, the paper P is caused to reverse its conveyance direction (the direction for the conveyance unit 40 to transport the paper P) by the backward rotations of the roller pairs 44 and 45, and is conveyed along the direction D2 from the downstream path R2 to the switchback path R3. Thereafter, the paper P is not caused to reverse its conveyance direction but to pass through the mergence position B from the switchback path R3 along the direction D2 and return to the upstream path R1. Then, the paper P is conveyed again in the direction D1 and, after the recording is carried out on the second surfaces at the facing position X, passes through the downstream path R2 to be received by the receiving unit 60.

When it is determined that it is necessary to dry the paper P (S2: Yes), then the CPU 1*c*1 extracts areas Px1 and Px2 (see FIGS. 6 and 7) where a predetermined amount or more of the ink is jetted on each sheet of the paper P (S4). In this embodiment, based on the image data included in the recording command, the CPU 1*c*1 calculates the amount of the ink jetted on each of a plurality of areas Px obtained by dividing the first surface of each sheet of the paper P into a matrix. Then the CPU 1*c*1 extracts the areas Px1 and Px2 where the jetted ink amount is not less than the predetermined amount.

Figure 6:
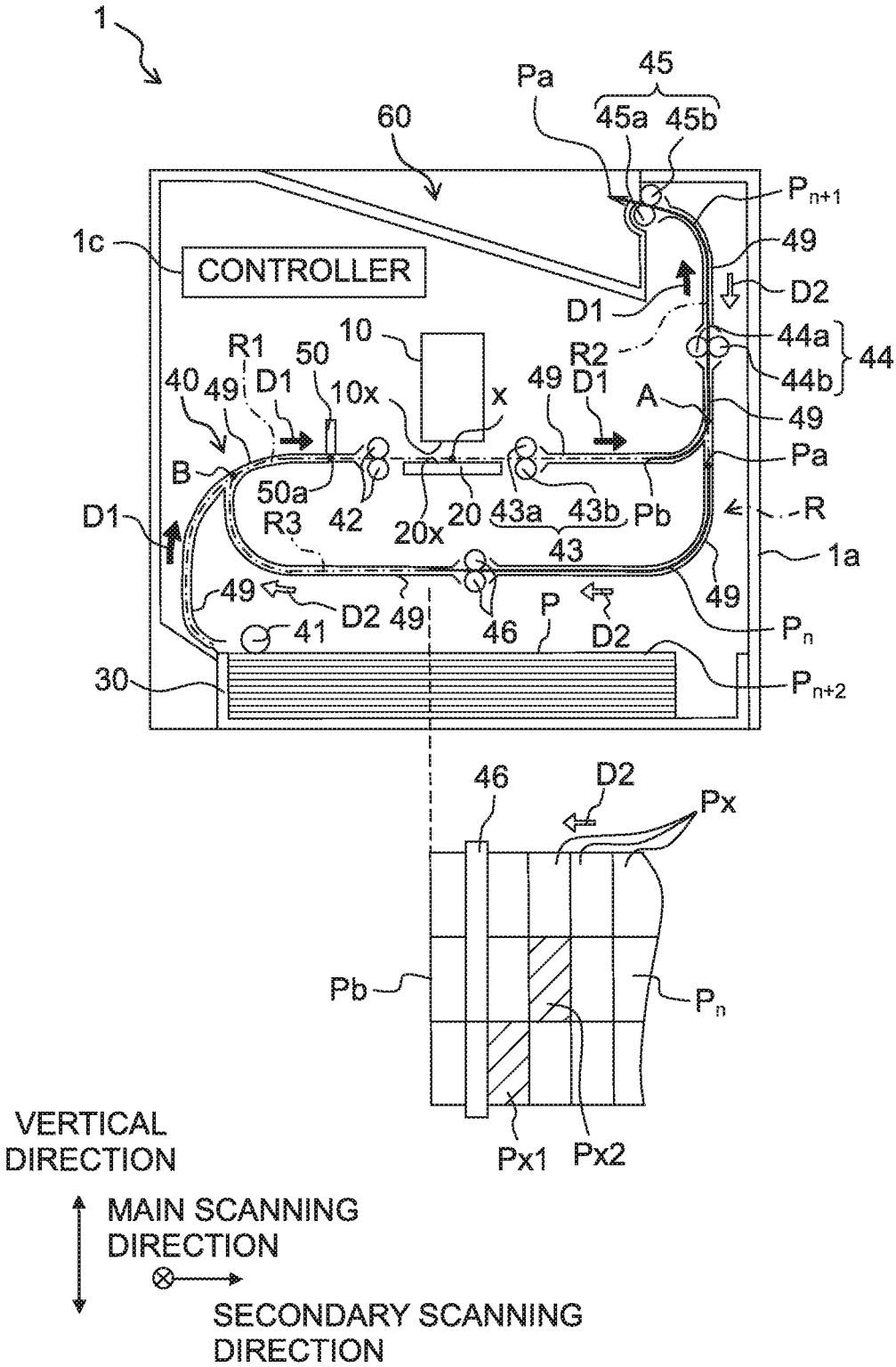
FIG. 6 is a schematic lateral view showing a state of the nth sheet of recording paper being stopped in a switchback path and the (n+1)th sheet of the recording paper being stopped in a downstream path, in the S7 "Conveyance control (two sheets being stopped and dried simultaneously)"
Figure 7:
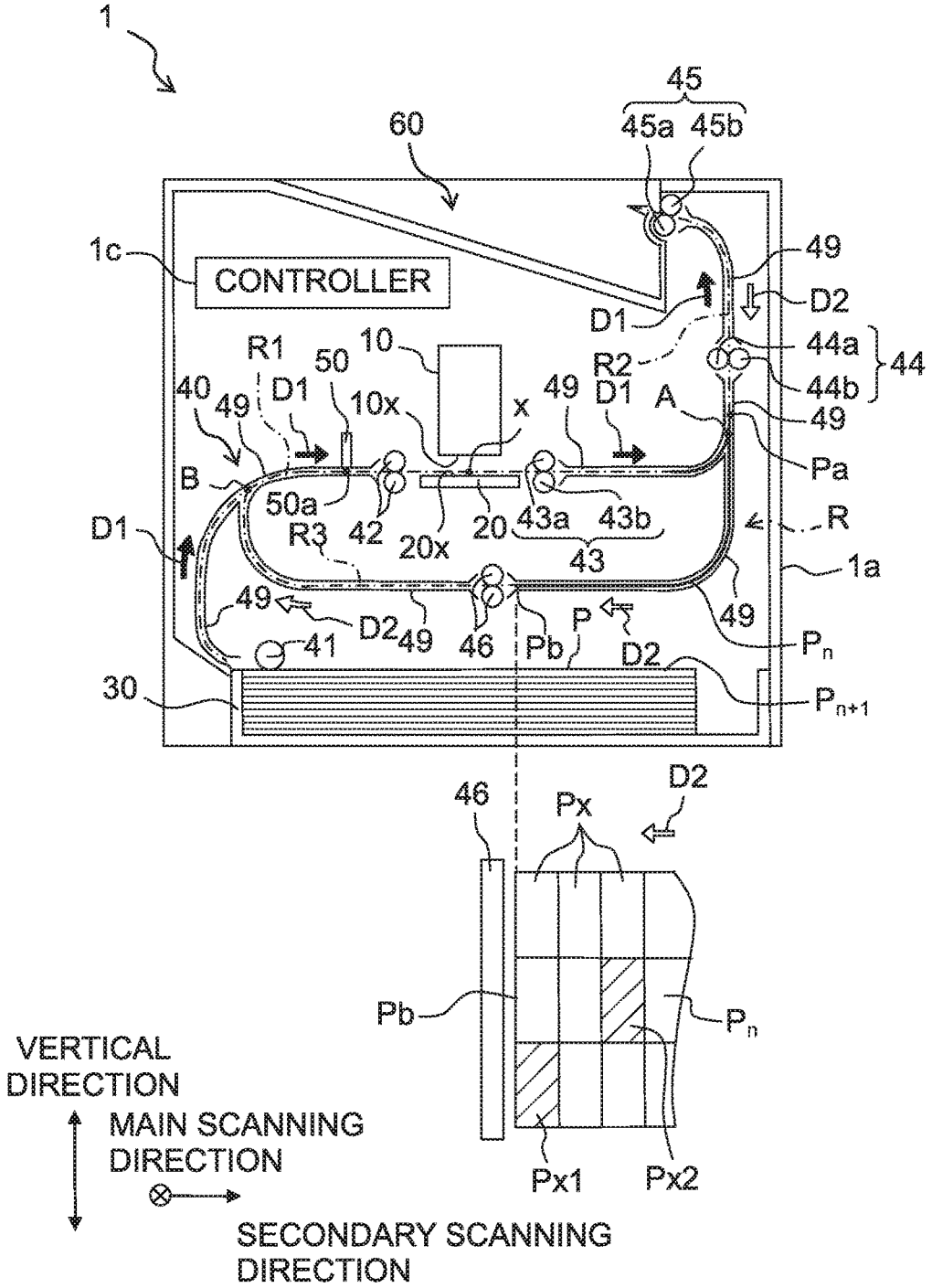
FIG. 7 is a schematic lateral view showing a state of the nth sheet of the recording paper being stopped in the switchback path, in a step S8 "Conveyance control (one sheet after another being stopped and dried"
Figure 8:
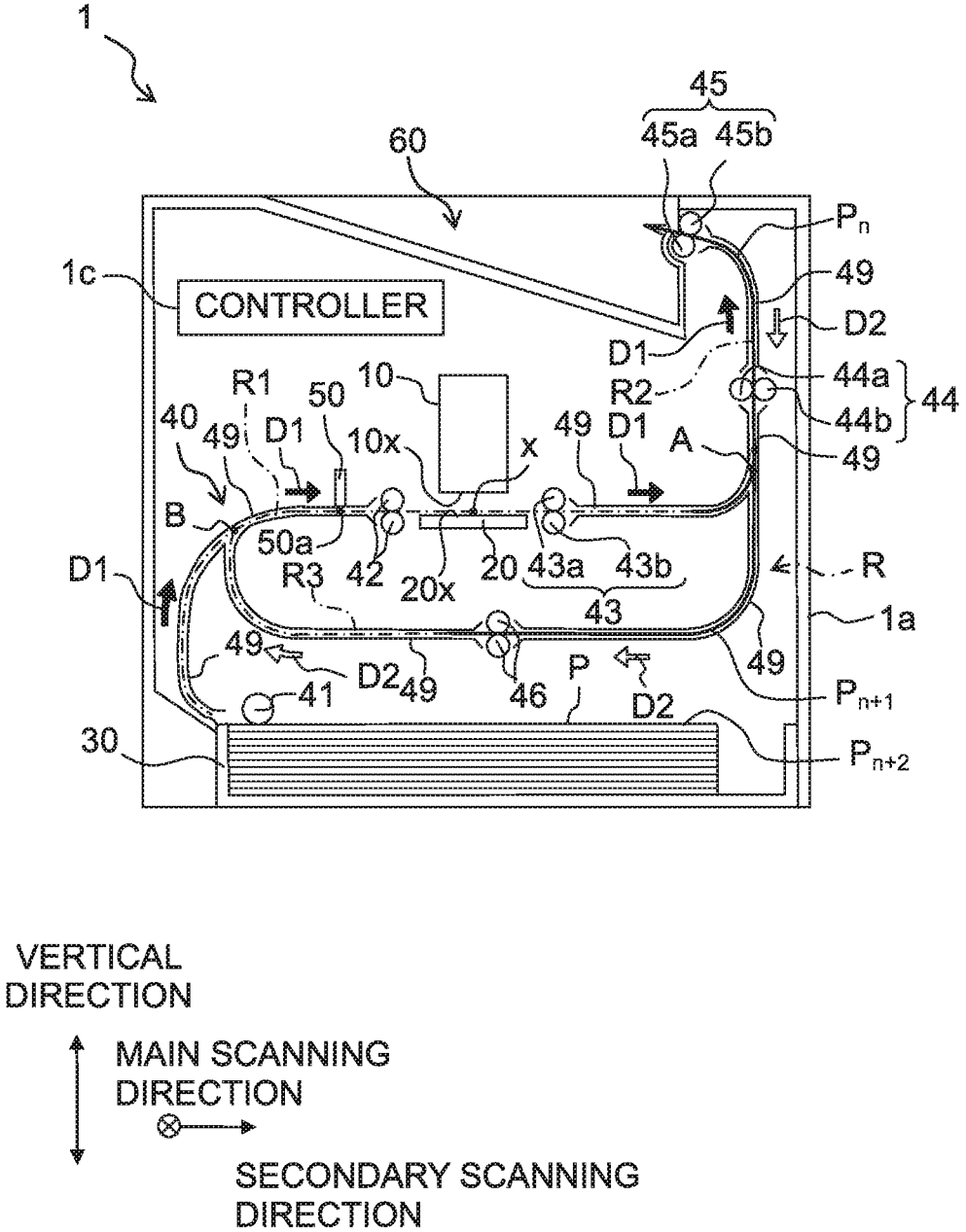
FIG. 8 is a schematic lateral view showing such a state that in the S7 "Conveyance control (two sheets being stopped and dried simultaneously)", following the state depicted in FIG. 6, the nth sheet of the recording paper, which was stopping in the switchback path, is returned to an upstream path and conveyed toward a receiving unit via the downstream path, and the (n+1)th sheet of the recording paper, which was stopping in the downstream path, is conveyed into the switchback path and stopped in the switchback path.

After S4, the CPU 1*c*1 prescribes a stop position for each sheet of the paper Pin the switchback path R3 such that the roller pair 46 may not contact with the areas Px1 and Px2 extracted in S4 (S5). As depicted in FIGS. 6 and 7 in particular, with the fore-end of the paper P according to the direction D1 as the anterior end Pa, and with the fore-end of the paper P according to the direction D2 as the posterior end Pb, the stop position is prescribed such that the paper P may be stopped when the area Px1 closest to the posterior end Pb nearly reaches to the roller pair 46.

After S5, the CPU 1*c*1 determines whether or not the paper P is partially within the downstream path R2 when each sheet of the paper P is stopped at the stop position prescribed in S5 (S6). For example, in the case of FIG. 6, it is determined that the paper P does not have any part within the downstream path R2 (S6: No), whereas in the case of FIG. 7, it is determined that the paper P is partially within the downstream path R2 (S6: Yes).

When it is determined that all sheets of the paper P do not have any part within the downstream path R2 (S6: No), then the CPU 1c1 carries out "Conveyance control (two sheets being stopped and dried simultaneously)" (S7). In S7, the CPU 1c1 controls the conveyance unit 40 to stop two sheets of the paper P in the conveyance path R for drying simultaneously, as each sheet of the paper P is in between the paper feed tray 30 and the receiving unit 60. As depicted in FIG. 6 in particular, the CPU 1c1 controls the conveyance unit 40 to stop the nth sheet of paper $P_n$ in a state of being at least partially within the switchback path R3. At the same time, the CPU 1c1 controls the conveyance unit 40 to stop the paper $P_{n+1}$ in such a state that the (n+1)th sheet of the paper $P_{n+1}$ is at least partially within the downstream path R2 while the paper $P_n$ is stopping in the state of being at least partially within the switchback path R3. Here, n is a natural number.

When it is determined that at least one sheet of the paper P is partially within the downstream path R2 (S6: Yes), then the CPU 1c1 carries out "Conveyance control (one sheet after another being stopped and dried)" (S8). In S8, the CPU 1c1 controls the conveyance unit 40 to stop one sheet after another of the paper P in the conveyance path R for drying, as each sheet of the paper P is in between the paper feed tray 30 and the receiving unit 60. As depicted in FIG. 7 in particular, the CPU 1c1 controls the conveyance unit 40 to stop the paper $P_n$ in a state of being at least partially within the switchback path R3. At the same time, the CPU 1c1 controls the conveyance unit 40 to stop the paper $P_{n+1}$ in such a state that the paper $P_{n+1}$ is at least partially within the switchback path R3 after the paper $P_n$ is received by the receiving unit 60.

In S7 and S8, whether in the single side continuous recording or in the both side continuous recording, the plurality of sheets of the paper P are conveyed in sequence from the paper feed tray 30 along the direction D1, pass through the upstream path R1, and arrive at the facing position X. Then, after the recording is carried out on the first surfaces at the facing position X, the plurality of sheets of the paper P are conveyed into the downstream path R2 and stopped for a time in the state of being nipped by the roller pairs 44 and 45. Then, the CPU 1c1 controls the conveyance unit 40 to reverse the conveyance direction of the paper P by the backward rotations of the roller pairs 44 and 45, and the paper P is conveyed along the direction D2 from the downstream path R2 to the switchback path R3. The paper P is stopped in the state of the paper P being at least partially within the switchback path R3 (see the paper $P_n$ in FIGS. 6 and 7). Then, after the paper P is dried, the CPU 1c1 controls the conveyance unit 40 not to reverse the paper P, but to pass through the mergence position B from the switchback path R3 along the direction D2 and return to the upstream path R1. Then, the paper P is conveyed again in the direction D1 and, via the facing position X, passes through the downstream path R2 to be received by the receiving unit 60. Further, at the facing position X, the recording is not carried out in the case of the single side continuous recording whereas the recording is carried out on the second surface in the case of the both side continuous recording.

In S7 and S8, therefore, when the both side continuous recording is carried out on three or more sheets of the paper P, then the recording is carried out in the order of being on the first surface of the paper $P_n$, the first surface of the paper $P_{n+1}$, the second surface of the paper $P_n$, the first surface of the paper $P_{n+2}$, and the second surface of the paper $P_{n+1}$. That is, the recording is carried out in the order of being on the 2nd page, the 4th page, the 1st page, the 6th page, and the 3rd page.

Further, in S7 and S8 for the single side continuous recording, the paper P finished with the recording on the first surface is conveyed from the downstream path R2 to the switchback path R3 with the conveyance direction reversed, and then conveyed from the switchback path R3 to the downstream path R2 again without the conveyance direction reversed to be finally received by the receiving unit 60. In this case, the first surface faces the opposite side from (the board side of) the receiving unit 60. Therefore, the CPU 1c1 controls the head 10 to carry out the recording on the pages in descending order.

Further, in S7 and S8, it is when the paper $P_{n+1}$ passes through the divergence position A along the direction D1 after the recording on the first surface but before the conveyance direction is reversed, that the paper $P_n$, which has stopped in the state of being at least partially within the switchback path R3, starts moving in the direction of returning to the upstream path R1 (in the direction D2) without the conveyance direction reversed such that the anterior end Pa of the paper $P_n$ is already past the divergence position A. Further, it is when the paper $P_n$ passes through the divergence position A along the direction D1 after being returned to the upstream path R1 but before being received by the receiving unit 60, that the paper $P_{n+1}$, which has stopped in the state of being at least partially within the switchback path R3, starts moving in the direction of returning to the upstream path R1 (in the direction D2) without the conveyance direction reversed such that the anterior end Pa of the paper $P_{n+1}$ is already past the divergence position A.

After the CPU 1c1 carries out S3 and S7 or S8 and all the paper P is finished with the recording and received by the receiving unit 60, the present routine is ended.

Next, referring to FIGS. 5A, 5B, 6 and 8, a concrete description will be made on S7: the "Conveyance control (two sheets being stopped and dried simultaneously)".

Figure 5A:
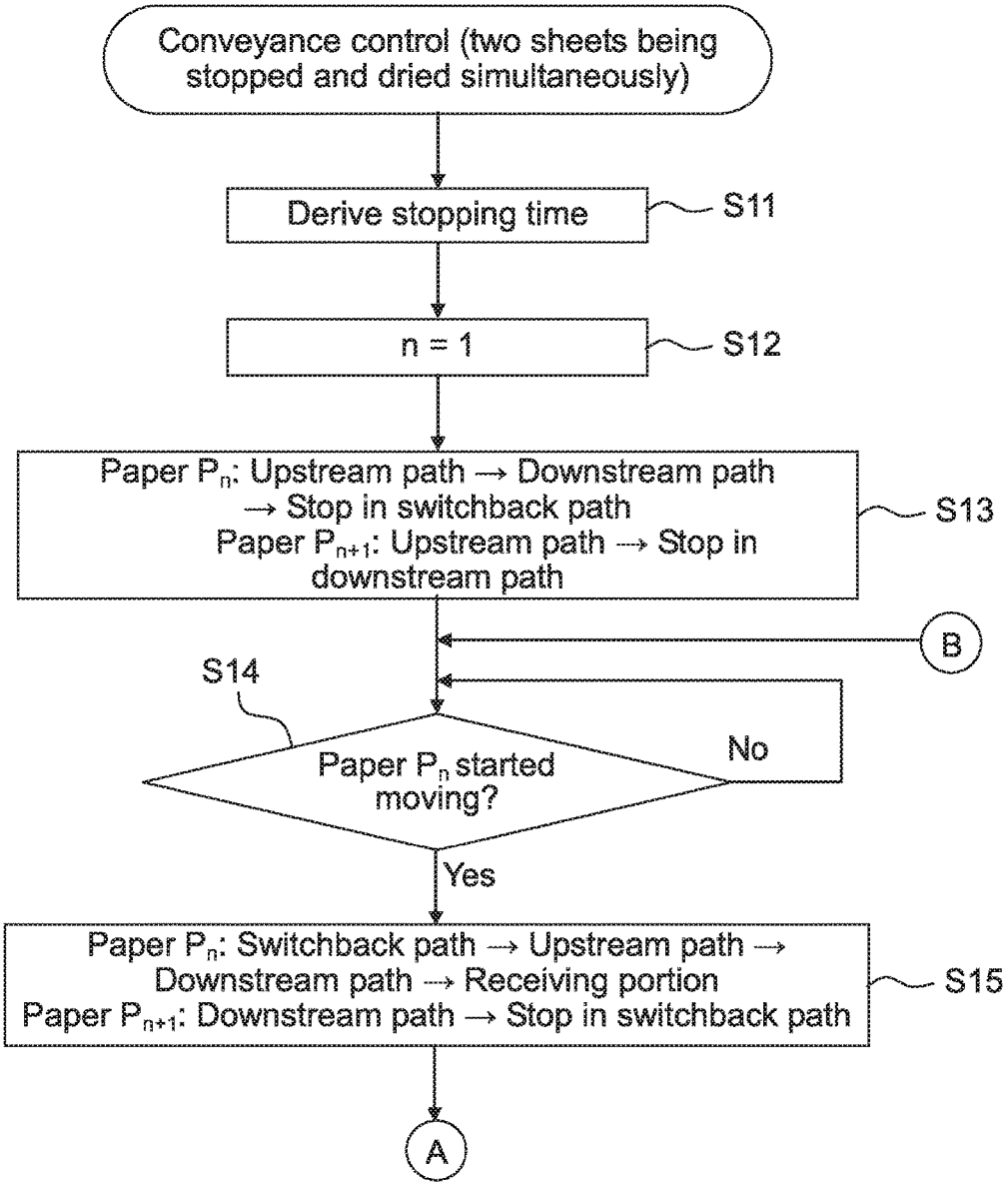
FIGS. 5A and 5B are flow diagrams showing a step S7 "Conveyance control (two sheets being stopped and dried simultaneously)" of FIG. 4.
Figure 5B:
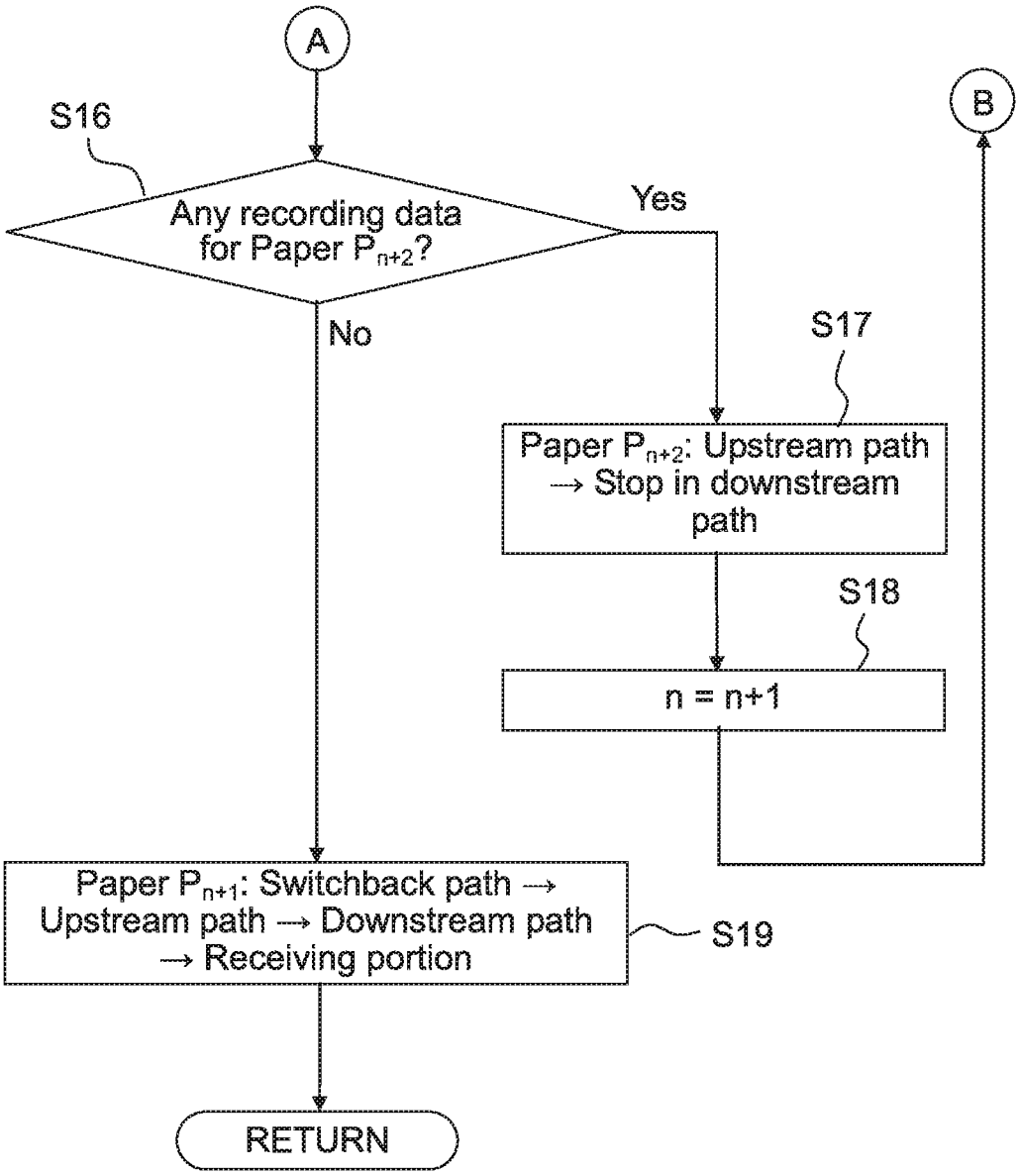

As depicted in FIGS. 5A and 5B, the CPU 1c1 first derives a stopping time needed to dry each sheet of the paper P (S11). In S11, the stopping time is derived on the basis of, for example, the amount of the ink jetted on each sheet of the paper P, the type of the paper P, and the like.

After S11, the CPU 1c1 sets "n=1" (S12).

After S12, the CPU 1c1 controls the conveyance unit 40 to convey the paper $P_n$ from the paper feed tray 30 to the upstream path R1 and the downstream path R2 along the direction D1, to convey the paper $P_n$ to the switchback path R3 with the conveyance direction reversed, and to stop the paper $P_n$ in the switchback path R3; on the other hand, the CPU 1c1 controls the conveyance unit 40 to convey the paper $P_{n+1}$ from the paper feed tray 30 to the upstream path R1 and the downstream path R2 along the direction D1, and to stop the paper $P_{n+1}$ in the downstream path R2 (S13: see FIG. 6). Here, the period when the paper $P_n$ is stopping in the switchback path R3 overlaps temporally with the period when the paper $P_{n+1}$ is stopping in the downstream path R2.

After S13, based on, for example, the driving condition of the conveyance motor 40M, the CPU 1c1 determines whether or not the paper $P_n$, which was stopping in the state of being at least partially within the switchback path R3, has started moving in the direction of returning to the upstream path R1 (in the direction D2) without the conveyance direction reversed (S14). In this embodiment, the CPU 1c1 controls the conveyance unit 40 to start moving the paper $P_n$ after the paper $P_n$ is dried (that is, at the time when the stopping time in the conveyance path R becomes not shorter than the stopping time derived in S11).

When it is determined that the paper $P_n$ has not yet started the above moving (S14: No), then the CPU 1c1 repeats the process of S14. During this period, the paper $P_{n+1}$ is maintained stopping in the downstream path R2.

When it is determined that the paper $P_n$ has started the above moving (S14: Yes), then the CPU 1c1 controls the conveyance unit 40 to reverse the conveyance direction of the paper $P_{n+1}$, which was stopping in the state of being at least partially within the downstream path R2, and to convey the paper $P_{n+1}$ to the switchback path R3 and to stop the paper $P_{n+1}$ in the state of being at least partially within the switchback path R3 (S15: see FIG. 8). Having started the above moving, the paper $P_n$ is conveyed again along the direction D1 after being returned to the upstream path R1 from the switchback path R3 and, via the facing position X (at this time, the recording is not carried out in the case of the single side continuous recording whereas the recording is carried out on the second surface in the case of the both side continuous recording), passes through the downstream path R2 to be received by the receiving unit 60.

After S15, the CPU 1c1 refers to the image data included in the recording command and determines whether or not there are recording data for the paper $P_{n+2}$ (S16).

When it is determined that there are recording data for the paper $P_{n+2}$ (S16: Yes), then the CPU 1c1 controls the conveyance unit 40 to convey the paper $P_{n+2}$ from the paper feed tray 30 to the upstream path R1 and the downstream path R2 along the direction D1, and to stop the paper $P_{n+2}$ in the downstream path R2 (S17). Here, the period when the paper $P_{n+1}$ is stopping in the switchback path R3 (S15) overlaps temporally with the period when the paper $P_{n+2}$ is stopping in the downstream path R2 (S17).

After S17, the CPU 1c1 sets "n=n+1" (S18). After S18, the CPU 1c1 returns the process to S14.

When it is determined that there are no recording data for the paper $P_{n+2}$ (S16: No), then the CPU 1c1 controls the conveyance unit 40 to start moving of the paper $P_{n+1}$, which was stopping in the state of being at least partially within the switchback path R3, after the paper $P_{n+1}$ is dried (that is, at the time when the stopping time in the conveyance path R becomes not shorter than the stopping time derived in S11), and the CPU 1c1 controls the conveyance unit 40 to convey the paper $P_1$ again in the direction D1 after being returned to the upstream path R1 and, via the facing position X, pass through the downstream path R2 to be received by the receiving unit 60 (S19).

Further, each sheet of the paper P may either be stopped or not be stopped in the state of being at least partially within the downstream path R2 after being returned to the upstream path R1 but before being received by the receiving unit 60.

After S19, the CPU 1c1 ends the present routine.

According to this embodiment as described above, when the recording is carried out continuously on the plurality of sheets of the paper P, the CPU 1c1 determines whether or not it is necessary to stop and dry the ink jetted paper P in the conveyance path R (S2: First determination process). Then, when it is determined that it is necessity to dry the paper P (S2: Yes), then the CPU 1c1 controls the conveyance unit 40 to stop the paper P in the conveyance path R (S7: Conveyance control process). In S7 as depicted in FIG. 6, the CPU 1c1 controls the conveyance unit 40 to stop the paper $P_n$ in the state of being at least partially within the switchback path R3, and to stop the paper $P_{n+1}$ in the state of being at least partially within the downstream path R2 while the paper $P_n$ is stopping in the state of being at least partially within the switchback path R3. That is, even when it is necessary to stop and dry the ink jetted paper P in the conveyance path R, each sheet of the paper P is not stopped in order in the same place, but the plurality of sheets of the paper P are stopped simultaneously in the switchback path R3 and the downstream path R2 respectively. By virtue of this, it is possible to reduce the total stopping and drying time during the recording, thereby restraining the throughput from decreasing.

In S14 as depicted in FIG. 5A, the CPU 1c1 determines whether or not the paper $P_n$, which was stopping in the state of being at least partially within the switchback path R3, has started moving in the direction of returning to the upstream path R1 (in the direction D2) without the conveyance direction reversed (S14: Second determination process). Then, when it is determined that the paper $P_n$ has not yet started the above moving (S14: No), then the CPU 1c1 controls the conveyance unit 40 to maintain stopping the paper $P_{n+1}$ in the downstream path R2. On the other hand, when it is determined that the paper $P_n$ has started the above moving (S14: Yes), then the CPU 1c1 controls the conveyance unit 40 to reverse the conveyance direction of the paper $P_{n+1}$, which was stopping in the state of being at least partially within the downstream path R2, and to convey the paper $P_{n+1}$ to the switchback path R3 (S15: see FIG. 8). According to the above configuration, it is possible to prevent sheets of the paper P from colliding with each other. Further, when the paper $P_n$ starts to move, then it is possible to further restrain the throughput from decreasing by not keeping the paper $P_{n+1}$ standing by until being dried but transporting the paper $P_{n+1}$ into the switchback path R3 and drying the same in the switchback path R3.

In S14 as depicted in FIG. 5A, the CPU 1c1 derives the stopping time needed to dry each sheet of the paper P (S11: Stopping time derivation process). Then, the CPU 1c1 causes the paper $P_n$ to start the moving in the direction of returning to the upstream path R1 (in the direction D2) without the conveyance direction reversed, after the paper $P_n$ is stopped in the state of being at least partially within the switchback path R3, such that the stopping time in the conveyance path R may become not shorter than the stopping time derived in S11 (see FIGS. 6 and 8). According to the above configuration, it is possible to prevent the ink from adhering to constituent members in the upstream path R1 by first drying and then returning the paper P to the upstream path R1.

The switchback path R3 diverges from the downstream path R2 and returns to the upstream path R1. According to the above configuration, by making use of a path provided originally for the both side recording as the switchback path R3, there is no need to add another path and thus it is possible to avoid complicating the apparatus configuration. Further, in S7 in the case of the both side continuous recording, the CPU 1c1 controls the conveyance unit 40 to return the paper $P_n$ with the recorded first surface to the upstream path R1 without the conveyance direction reversed after stopping the same in the state of being at least partially within the switchback path R3. The CPU 1c1 controls the conveyance unit 40 to convey the paper $P_n$ from the downstream path R2 to the receiving unit 60 after carrying out the recording on the second surface at the facing position X, and to stop the paper $P_{n+1}$ with the recorded first surface in the state of being at least partially within the downstream path R2 while the paper $P_n$ with the recorded first surface is stopping in the state of being at least partially within the switchback path R3 (see FIGS. 5A, 5B, 6 and 8). According to the above configuration, by first stopping the paper $P_n$ with the recorded first surface in the switchback path R3, and then conveying the paper $P_n$ into the upstream path R1 to carry out the recording on the second surface, it is possible to reduce the time for the paper $P_n$ to arrive again at the facing position X after being stopped and dried, thereby swiftly carrying out the recording on the second surface of the paper $P_n$.

When the both side continuous recording is carried out on three or more sheets of the paper P, then the CPU 1c1 controls the conveyance unit 40 and the head 10 to carry out the recording in the order of being on the first surface of the paper $P_n$, the first surface of the paper $P_{n+1}$, the second surface of the paper $P_n$, the first surface of the paper $P_{n+2}$, and the second surface of the paper $P_{n+1}$ (that is, the 2nd page, the 4th page, the 1st page, the 6th page, and the 3rd page). By carrying out the recording in such order as described above, it is possible to raise the throughput.

In this embodiment, in the case of the single side continuous recording, when the paper P finished with the recording on the first surface is conveyed from the downstream path R2 to the switchback path R3 with the conveyance direction reversed, and then conveyed from the switchback path R3 to the downstream path R2 again without the conveyance direction reversed to be finally received by the receiving unit 60, then the first surface faces the opposite side from (the board side of) the receiving unit 60. In S7 in the case of the single side continuous recording, therefore, the CPU 1c1 controls the head 10 to carry out the recording on the pages in descending order. On such occasion as described above, when the recording is carried out on the pages in ascending order, then after the recording is finished, the pages of the paper P in the receiving unit 60 are in descending order, and therefore the user needs to realign the order of the pages. In this regard, according to the above configuration, after the recording is finished, the pages of the paper P in the receiving unit 60 are in ascending order, and thus the user does not need to realign the order of the pages.

As depicted in FIG. 4, the CPU 1c1 extracts the areas Px1 and Px2 (see FIGS. 6 and 7) where the predetermined amount or more of the ink is jetted on the paper P (S4: Extraction process). Then, after S4, the CPU 1c1 prescribes the stop position for the paper P in the switchback path R3 such that the roller pair 46 may not contact with the areas Px1 and Px2 extracted in S4 (S5). According to the above configuration, it is possible to prevent the ink adhering to the paper P from transferring to the roller pair 46 (eventually to prevent the ink adhering to the roller pair 46 from transferring to the paper P being conveyed along the switchback path R3). Further, when the switchback path R3 is a path for the both side recording as in this embodiment, then in comparison with such a configuration of prescribing the stop position that the paper P may not contact with the roller pair 46, it is possible to place the paper P in such a position in the switchback path R3 as close to the upstream path R1, thereby enabling the recording on the second surface to be carried out swiftly.

As depicted in FIG. 4, after S5 and before S7, the CPU 1c1 determines whether or not the paper P is partially within the downstream path R2 when the paper P is stopped at the stop position prescribed in S5 (S6: Third determination process). When it is determined that the paper P does not have any part within the downstream path R2 (S6: No), then the CPU 1c1 carries out the step S7, causing the conveyance unit 40 to stop the paper $P_n$ in the state of being at least partially within the switchback path R3, and causing the paper $P_{n+1}$ to stop in the state of being at least partially within the downstream path R2 while the paper $P_n$ is stopping in the state of being at least partially within the switchback path R3 (see FIG. 6). When it is determined that the paper P is partially within the downstream path R2 (S6: Yes), then the CPU 1c1 carries out the step S8, causing the conveyance unit to stop the paper $P_n$ in the state of being at least partially within the switchback path R3, and causing the conveyance unit 40 to stop the paper $P_{n+1}$ in the state of being at least partially within the switchback path R3 after the paper $P_n$ is received by the receiving unit 60 (see FIG. 7). According to the above configuration, it is possible to select an appropriate process in accordance with the length and/or stop position of the paper P to dry the paper P.

The conveyance unit 40 includes the spur rollers (the rollers 43*a* to 45*a*) in contact with the paper P in the downstream path R2 to transport the paper P. Those spur rollers have a small contact area with the paper P, so as to be in point contact with the paper P. Therefore, according to the above configuration, it is possible to prevent the ink adhering to the paper P from transferring to the rollers 43*a* to 45*a* when the paper P finished with the recording is conveyed along the downstream path R2 (eventually to prevent the ink adhering to the rollers 43*a* to 45*a* from transferring to the paper P conveyed along the downstream path R2).

Next, another embodiment of the present teaching will be explained.

This embodiment is the same as the embodiment described above except for the control contents for the both side continuous recording in S7. It is not indispensable for the above embodiment to stop the paper P on which the recording has been carried out on both sides in the both side continuous recording in S7, in the state of being at least partially within the downstream path R2 before being received by the receiving unit 60. However, that is indispensable for this embodiment. Further, the paper $P_n$ with the recorded first surface and the paper $P_{n+1}$ with the recorded first surface are stopped and dried respectively in the switchback path R3 and in the downstream path R2 in the above embodiment, whereas the paper $P_n$ with the both recorded surfaces and the paper $P_{n+1}$ with the recorded first surface are stopped and dried respectively in the downstream path R2 and in the switchback path R3 in this embodiment (that is, three surfaces in total are dried simultaneously: the first surface and the second surface of the paper $P_n$, and the first surface of the paper $p_{n+1}$).

More specifically, in this embodiment, when the both side continuous recording is carried out in S7, the CPU 1c1 controls the conveyance unit 40 to convey the paper $P_n$ with the recorded first surface from the downstream path R2 to the switchback path R3 with the conveyance direction reversed, and yet not to be stopped in the switchback path R3 but to be returned to the upstream path R1 from the switchback path R3. Then, the CPU 1c1 controls the conveyance unit 40 to stop the paper $P_n$ in the state of being at least partially within the downstream path R2 after being conveyed from the upstream path R1 to the downstream path R2 while the recording is carried out on the second surface at the facing position X. The CPU 1c1 controls the conveyance unit 40 to convey the paper $P_n$ to the receiving unit 60 after the paper $P_n$ is dried (that is, at the time when the stopping time in the conveyance path R becomes not shorter than the stopping time derived in S11). Further, the CPU 1c1 controls the conveyance unit 40 to convey the paper $P_{n+1}$ with the recorded first surface from the downstream path R2 to the switchback path R3 with the conveyance direction reversed, and to stop in the state of being at least partially within the switchback path R3 while the paper $P_n$ is stopping in the state of being at least partially within the downstream path R2 (see FIG. 8). Here, the period when the paper $P_n$ is stopping in the downstream path R2 overlaps temporally with the period when the paper $P_{n+1}$ is stopping in the switchback path R3.

As described above, according to this embodiment, the paper $P_n$ finished with the both side recording is stopped in the downstream path R2 to dry the both surfaces, while the paper $P_{n+1}$ finished with the single side recording is stopped in the switchback path R3 to dry the single side (the first surface). That is, by simultaneously drying the total three surfaces in the two places, it is possible to more reliably restrain the throughput from decreasing.

Further, in this embodiment, the CPU 1*c*1 controls the conveyance unit 40 to convey the paper $P_n$ finished with the both side recording to the receiving unit 60 after being stopped in the state of being at least partially within the downstream path R2, such that the stopping time in the conveyance path R may become not shorter than the stopping time derived in S11. In this manner, by transporting the paper P to the receiving unit 60 after being dried, it is possible to more reliably prevent the ink from adhering to the receiving unit 60 or to the paper P received in the receiving unit 60.

While the embodiments of the present teaching were explained above, the present teaching is not limited to the embodiments described above but, as in the following manner for example, various design changes are possible as far as confined to the description of the appended claims.

The liquid jetting unit is not limited to being of line type but may be of serial type. The liquid jetted by the liquid jetting unit is not limited to ink but may be any liquid (for example, a pretreatment liquid). The number of liquid jetting units included in the recording apparatus may be one or be any number more than one. The container unit is not limited to being attachable to and removable from the case of the recording apparatus but, for example, may be drawable out of the case or openable and closable to the case (a manual feed tray or the like). The receiving unit is not limited to being constructed from the top board of the case but, for example, may be constructed from such a member as attachable to and removable from or drawable out of or openable and closable to the case. The conveyance unit may include a belt or belts to replace or add to the rollers and guides. The conveyance member is not limited to the roller pairs but may be a belt(s) or the like. The conveyance path is not limited to the configuration as in the embodiments described above. For example, the upstream path and/or the downstream path may have such a shape as along a horizontal plane. The switchback path may return to the downstream path. In such a case, the divergence position from the downstream path for the switchback path may be the same position as the mergence position into the downstream path for the switchback path. The recording medium is not limited to paper but, for example, may be any recordable medium such as cloth or the like. The recording apparatus according to the present teaching is not limited to a printer but may be a facsimile machine or a photocopy machine.

What is claimed is:

1. A recording apparatus configured to jet liquid onto a recording medium comprising:

a liquid jetting unit including a plurality of nozzles to jet the liquid;

a container unit configured to contain the recording medium to be fed to the liquid jetting unit;

a receiving unit configured to receive the recording medium on which the liquid has been jetted by the liquid jetting unit;

a conveyance unit configured to convey the recording medium along a conveyance path which extends from the container unit to the receiving unit via a facing position facing the plurality of nozzles; and a controller configured to control the conveyance unit and the liquid jetting unit, wherein the conveyance path includes an upstream path from the container unit to the facing position, a downstream path from the facing position to the receiving unit, and a switchback path diverging from the downstream path and returning to the upstream path or the downstream path;

wherein the controller is configured to carry out:

transporting one recording medium, of the recording media, which has been conveyed from the upstream path to the downstream path and on which the recording has been carried out at the facing position, to the switchback path by reversing a conveyance direction which is the direction for the conveyance unit to transport the recording medium, and then stopping the one recording medium in a state of being at least partially within the switchback path, and stopping another recording medium, of the recording media, in a state that the another recording medium is at least partially within the downstream path while the one recording medium is stopping in the state of being at least partially within the switchback path, where the another recording medium is different from the one recording medium, is conveyed from the upstream path to the downstream path, and is finished with the recording at the facing position.

2. The recording apparatus according to claim 1, wherein the controller is configured to carry out:

maintaining the another recording medium stopping in the downstream path until it is determined that the one recording medium, which was stopping in the state of being at least partially within the switchback path, has started the moving; and conveying the another recording medium, which was stopping in the state of being at least partially within the downstream path, to the switchback path by reversing the conveyance direction, under a condition that it is determined that the one recording medium has started the moving.

3. The recording apparatus according to claim 1, wherein the switchback path is defined to diverge from the downstream path and return to the upstream path, and in a case that each of the plurality of recording media has a first surface and a second surface on the other side of the first surface and that the recording is carried out continuously on the first and second surfaces, the controller is configured to control the liquid jetting unit and the conveyance unit to carry out:

returning the one recording medium, on the first surface of which the recording has been conducted, to the upstream path without reversing the conveyance direction again, after the one recording medium with the recorded first surface is stopped in the state of being at least partially within the switchback path;

recording on the second surface at the facing position;

conveying the one recording medium from the downstream path to the receiving unit after the recording is conducted on the second surface at the facing position; and stopping the another recording medium in the state of the another recording medium, on the first surface of which the recording has been conducted, being at least partially within the downstream path, while the one recording medium, on the first surface of which the recording has been conducted, is stopping in the state of being at least partially within the switchback path.

4. The recording apparatus according to claim 3, wherein in the case that the recording is carried out continuously on three or more of the recording media, the controller controls the conveyance unit and the liquid jetting unit to carry out:

recording in the order of being on the first surface of the nth recording medium (n is a natural number), the first surface of the (n+1)th recording medium, the second surface of the nth recording medium, the first surface of the (n+2)th recording medium, and the second surface of the (n+1)th recording medium.

5. The recording apparatus according to claim 1, wherein the switchback path is defined to diverge from the downstream path and return to the upstream path, and in the case that each of the plurality of recording media has a first surface and a second surface on the other side of the first surface and that the recording is carried out continuously on the first and second surfaces, the controller is configured to control the liquid jetting unit and the conveyance unit to carry out:

conveying the another recording medium, on the first surface of which the recording has been conducted, to the switchback path from the downstream path by reversing the conveyance direction and returning the another recording medium to the upstream path from the switchback path without reversing the conveyance direction again;

conveying the another recording medium, on the first surface of which the recording has been conducted, to the downstream path from the upstream path while conducting the recording on the second surface at the facing position;

stopping the another recording medium in the state of the another recording medium being at least partially within the downstream path, after conducting the recording on the second surface at the facing position;

conveying the one recording medium, on the first surface of which the recording has been conducted and on which the next recording will be conducted following the another recording medium, to the switchback path from the downstream path by reversing the conveyance direction; and stopping the one recording medium, on which the next recording will be conducted following the other recording medium, in the state of being at least partially within the switchback path, while the another recording medium is stopping in the state of being at least partially within the downstream path.

6. The recording apparatus according to claim 1, wherein in the case that each of the plurality of recording media has a first surface and a second surface on the other side of the first surface and that the recording is carried out continuously on the first surfaces, and in a case that the recording media finished with the recording on the first surfaces are conveyed from the downstream path to the switchback path with the conveyance direction reversed, and then conveyed from the switchback path to the downstream path again without the conveyance direction reversed again to be received by the receiving unit, the controller is configured to control the liquid jetting unit to carry out recording on the pages in descending order when the first surfaces face the opposite side from the receiving unit.

7. The recording apparatus according to claim 1, wherein the conveyance unit includes a conveyance member to contact with the recording medium in the switchback path to transport the recording medium, and wherein the controller is configured to carry out:

prescribing a stop position for the recording medium in the switchback path such that an area of the recording medium, in which a predetermined amount or more of the liquid is jetted therein, does not contact with the conveyance member.

8. The recording apparatus according to claim 7, wherein the controller is configured to carry out:

determining whether or not the recording medium is partially within the downstream path under a condition that the recording medium is stopped at the stop position, before the controller controls the conveyance unit to stop the recording medium in the conveyance path, after prescribing the stop position for the recording medium in the switchback path such that the area of the recording medium, in which the predetermined amount or more of the liquid is jetted therein, does not contact with the conveyance member;

in a case that the controller determines that the recording medium is not partially within the downstream path, the controller is configured to control the conveyance unit to carry out:

stopping the one recording medium such that the one recording medium is at least partially within the switchback path; and stopping the another recording medium such that the another recording medium is at least partially within the downstream path while the one recording medium is stopping in the state of being at least partially within the switchback path, in a case that the controller determines that the recording medium is partially within the downstream path, the controller is configured to control the conveyance unit to carry out:

stopping the one recording medium such that the one recording medium is at least partially within the switchback path; and stopping the another recording medium such that the another recording medium is at least partially within the switchback path after the one recording medium is received by the receiving unit.

9. The recording apparatus according to claim 1, wherein the conveyance unit includes a spur roller to contact with the recording medium in the downstream path to convey the recording medium.

10. A recording apparatus configured to jet liquid onto a recording medium comprising:

a liquid jetting unit including a plurality of nozzles to jet the liquid;

a container unit configured to contain the recording medium to be fed to the liquid jetting unit;

a receiving unit configured to receive the recording medium on which the liquid has been jetted by the liquid jetting unit;

a conveyance unit configured to convey the recording medium along a conveyance path which extends from the container unit to the receiving unit via a facing position facing the plurality of nozzles; and a controller configured to control the conveyance unit and the liquid jetting unit, wherein the conveyance path includes an upstream path from the container unit to the facing position, a downstream path from the facing position to the receiving unit, and a switchback path diverging from the downstream path and returning to the upstream path or the downstream path;

wherein the controller is configured to carry out:

determining whether or not it is necessary to stop and dry the liquid jetted recording medium in the conveyance path under a condition that the recording is carried out continuously on the recording medium including a plurality of media, and controlling the conveyance unit to stop the recording medium in the conveyance path under a condition that the controller determines that it is necessary to dry the recording medium; and wherein in a case of controlling the conveyance unit to stop the recording medium in the conveyance path, the controller is configured to carry out:

transporting one recording medium, of the recording media, which has been conveyed from the upstream path to the downstream path and on which the recording has been carried out at the facing position, to the switchback path by reversing a conveyance direction which is the direction for the conveyance unit to transport the recording medium, and then stopping the one recording medium in a state of being at least partially within the switchback path, and positioning another recording medium, of the recording media, such that at least a part of the another recording medium is located within the downstream path while the one recording medium is stopping in the state of being at least partially within the switchback path, where the another recording medium is different from the one recording medium, has been conveyed from the upstream path to the downstream path, and has been finished with the recording at the facing position.

11. The recording apparatus according to claim 10, wherein the controller is configured to carry out:

stopping the another recording medium in the state of being at least partially within the downstream path until it is determined that the one recording medium, which was stopping in the state of being at least partially within the switchback path, has started the moving; and conveying the another recording medium, which was stopping in the state of being at least partially within the downstream path, to the switchback path by reversing the conveyance direction, under a condition that it is determined that the one recording medium has started the moving.

12. The recording apparatus according to claim 10, wherein the switchback path is defined to diverge from the downstream path and return to the upstream path, and in a case that each of the plurality of recording media has a first surface and a second surface on the other side of the first surface and that the recording is carried out continuously on the first and second surfaces, the controller is configured to control the liquid jetting unit and the conveyance unit to carry out:

returning the one recording medium, on the first surface of which the recording has been conducted, to the upstream path without reversing the conveyance direction again, after the one recording medium with the recorded first surface is stopped in the state of being at least partially within the switchback path;

recording on the second surface at the facing position;

conveying the one recording medium from the downstream path to the receiving unit after the recording is conducted on the second surface at the facing position; and stopping the another recording medium in the state of the another recording medium, on the first surface of which the recording has been conducted, being at least partially within the downstream path, while the one recording medium, on the first surface of which the recording has been conducted, is stopping in the state of being at least partially within the switchback path.

13. The recording apparatus according to claim 12, wherein in the case that the recording is carried out continuously on three or more of the recording media, the controller controls the conveyance unit and the liquid jetting unit to carry out:

recording in the order of being on the first surface of the nth recording medium (n is a natural number), the first surface of the (n+1)th recording medium, the second surface of the nth recording medium, the first surface of the (n+2)th recording medium, and the second surface of the (n+1)th recording medium.

14. The recording apparatus according to claim 10, wherein the switchback path is defined to diverge from the downstream path and return to the upstream path, and in the case that each of the plurality of recording media has a first surface and a second surface on the other side of the first surface and that the recording is carried out continuously on the first and second surfaces, the controller is configured to control the liquid jetting unit and the conveyance unit to carry out:

conveying the another recording medium, on the first surface of which the recording has been conducted, to the switchback path from the downstream path by reversing the conveyance direction and returning the another recording medium to the upstream path from the switchback path without reversing the conveyance direction again;

conveying the another recording medium, on the first surface of which the recording has been conducted, to the downstream path from the upstream path while conducting the recording on the second surface at the facing position;

stopping the another recording medium in the state of the another recording medium being at least partially within the downstream path, after conducting the recording on the second surface at the facing position;

conveying the one recording medium, on the first surface of which the recording has been conducted and on which the next recording will be conducted following the another recording medium, to the switchback path from the downstream path by reversing the conveyance direction; and stopping the one recording medium, on which the next recording will be conducted following the other recording medium, in the state of being at least partially within the switchback path, while the another recording medium is stopping in the state of being at least partially within the downstream path.

15. The recording apparatus according to claim 10, wherein in the case that each of the plurality of recording media has a first surface and a second surface on the other side of the first surface and that the recording is carried out continuously on the first surfaces, and in a case that the recording media finished with the recording on the first surfaces are conveyed from the downstream path to the switchback path with the conveyance direction reversed, and then conveyed from the switchback path to the downstream path again without the conveyance direction reversed again to be received by the receiving unit, the controller is configured to control the liquid jetting unit to carry out recording on the pages in descending order when the first surfaces face the opposite side from the receiving unit.

16. The recording apparatus according to claim 10, wherein the conveyance unit includes a conveyance member to contact with the recording medium in the switchback path to transport the recording medium, and wherein the controller is configured to carry out:

prescribing a stop position for the recording medium in the switchback path such that an area of the recording medium, in which a predetermined amount or more of the liquid is jetted therein, does not contact with the conveyance member.

17. The recording apparatus according to claim 16, wherein the controller is configured to carry out:

determining whether or not the recording medium is partially within the downstream path under a condition that the recording medium is stopped at the stop position, before the controller controls the conveyance unit to stop the recording medium in the conveyance path, after prescribing the stop position for the recording medium in the switchback path such that the area of the recording medium, in which the predetermined amount or more of the liquid is jetted therein, does not contact with the conveyance member;

in a case that the controller determines that the recording medium is not partially within the downstream path, the controller is configured to control the conveyance unit to carry out:

stopping the one recording medium such that the one recording medium is at least partially within the switchback path; and stopping the another recording medium such that the another recording medium is at least partially within the downstream path while the one recording medium is stopping in the state of being at least partially within the switchback path, in a case that the controller determines that the recording medium is partially within the downstream path, the controller is configured to control the conveyance unit to carry out:

stopping the one recording medium such that the one recording medium is at least partially within the switchback path; and stopping the another recording medium such that the another recording medium is at least partially within the switchback path after the one recording medium is received by the receiving unit.

18. The recording apparatus according to claim 10, wherein the conveyance unit includes a spur roller to contact with the recording medium in the downstream path to convey the recording medium.

19. A recording apparatus configured to jet liquid onto a recording medium comprising:

a liquid jetting unit including a plurality of nozzles to jet the liquid;

a container unit configured to contain the recording medium to be fed to the liquid jetting unit;

a receiving unit configured to receive the recording medium on which the liquid has been jetted by the liquid jetting unit;

a conveyance unit configured to convey the recording medium along a conveyance path which extends from the container unit to the receiving unit via a facing position facing the plurality of nozzles; and a controller configured to control the conveyance unit and the liquid jetting unit, wherein the conveyance path includes an upstream path from the container unit to the facing position, a downstream path from the facing position to the receiving unit, and a switchback path diverging from the downstream path and returning to the upstream path or the downstream path;

wherein the controller is configured to carry out:

transporting one recording medium, of the recording media, which has been conveyed from the upstream path to the downstream path and on which the recording has been carried out at the facing position, to the switchback path by reversing a conveyance direction which is the direction for the conveyance unit to transport the recording medium, and then stopping the one recording medium in a state of being at least partially within the switchback path; and stopping another recording medium, of the recording media, in a state that the another recording medium is at least partially within the downstream path while the one recording medium is stopping in the state of being at least partially within the switchback path, where the another recording medium is different from the one recording medium, is conveyed from the upstream path to the downstream path, and is finished with the recording at the facing position, wherein the controller is configured to carry out:

controlling the conveyance unit to stop the recording medium in the conveyance path to dry the recording medium, under a condition that an amount of the liquid jetted onto the recording medium is not less than a threshold amount; and controlling the conveyance unit to convey the recording medium in the conveyance path without stopping the recording medium in the conveyance path, under a condition that the amount of the liquid jetted onto the recording medium is less than the threshold amount.

20. The recording apparatus according to claim 19, wherein the controller is configured to carry out:

maintaining the another recording medium stopping in the downstream path until it is determined that the one recording medium, which was stopping in the state of being at least partially within the switchback path, has started the moving; and conveying the another recording medium, which was stopping in the state of being at least partially within the downstream path, to the switchback path by reversing the conveyance direction, under a condition that it is determined that the one recording medium has started the moving.

21. The recording apparatus according to claim 19, wherein the switchback path is defined to diverge from the downstream path and return to the upstream path, and in a case that each of the plurality of recording media has a first surface and a second surface on the other side of the first surface and that the recording is carried out continuously on the first and second surfaces, the controller is configured to control the liquid jetting unit and the conveyance unit to carry out:

returning the one recording medium, on the first surface of which the recording has been conducted, to the upstream path without reversing the conveyance direction again, after the one recording medium with the recorded first surface is stopped in the state of being at least partially within the switchback path;

recording on the second surface at the facing position;

conveying the one recording medium from the downstream path to the receiving unit after the recording is conducted on the second surface at the facing position; and stopping the another recording medium in the state of the another recording medium, on the first surface of which the recording has been conducted, being at least partially within the downstream path, while the one recording medium, on the first surface of which the recording has been conducted, is stopping in the state of being at least partially within the switchback path.

22. The recording apparatus according to claim 21, wherein in the case that the recording is carried out continuously on three or more of the recording media, the controller controls the conveyance unit and the liquid jetting unit to carry out:

recording in the order of being on the first surface of the nth recording medium (n is a natural number), the first surface of the (n+1)th recording medium, the second surface of the nth recording medium, the first surface of the (n+2)th recording medium, and the second surface of the (n+1)th recording medium.

23. The recording apparatus according to claim 19, wherein the switchback path is defined to diverge from the downstream path and return to the upstream path, and in the case that each of the plurality of recording media has a first surface and a second surface on the other side of the first surface and that the recording is carried out continuously on the first and second surfaces, the controller is configured to control the liquid jetting unit and the conveyance unit to carry out:

conveying the another recording medium, on the first surface of which the recording has been conducted, to the switchback path from the downstream path by reversing the conveyance direction and returning the another recording medium to the upstream path from the switchback path without reversing the conveyance direction again;

conveying the another recording medium, on the first surface of which the recording has been conducted, to the downstream path from the upstream path while conducting the recording on the second surface at the facing position;

stopping the another recording medium in the state of the another recording medium being at least partially within the downstream path, after conducting the recording on the second surface at the facing position;

conveying the one recording medium, on the first surface of which the recording has been conducted and on which the next recording will be conducted following the another recording medium, to the switchback path from the downstream path by reversing the conveyance direction; and stopping the one recording medium, on which the next recording will be conducted following the other recording medium, in the state of being at least partially within the switchback path, while the another recording medium is stopping in the state of being at least partially within the downstream path.

24. The recording apparatus according to claim 19, wherein in the case that each of the plurality of recording media has a first surface and a second surface on the other side of the first surface and that the recording is carried out continuously on the first surfaces, and in a case that the recording media finished with the recording on the first surfaces are conveyed from the downstream path to the switchback path with the conveyance direction reversed, and then conveyed from the switchback path to the downstream path again without the conveyance direction reversed again to be received by the receiving unit, the controller is configured to control the liquid jetting unit to carry out recording on the pages in descending order when the first surfaces face the opposite side from the receiving unit.

25. The recording apparatus according to claim 19, wherein the conveyance unit includes a conveyance member to contact with the recording medium in the switchback path to transport the recording medium, and wherein the controller is configured to carry out:

prescribing a stop position for the recording medium in the switchback path such that an area of the recording medium, in which a predetermined amount or more of the liquid is jetted therein, does not contact with the conveyance member.

26. The recording apparatus according to claim 25, wherein the controller is configured to carry out:

determining whether or not the recording medium is partially within the downstream path under a condition that the recording medium is stopped at the stop position, before the controller controls the conveyance unit to stop the recording medium in the conveyance path, after prescribing the stop position for the recording medium in the switchback path such that the area of the recording medium, in which the predetermined amount or more of the liquid is jetted therein, does not contact with the conveyance member;

in a case that the controller determines that the recording medium is not partially within the downstream path, the controller is configured to control the conveyance unit to carry out:

stopping the one recording medium such that the one recording medium is at least partially within the switchback path; and stopping the another recording medium such that the another recording medium is at least partially within the downstream path while the one recording medium is stopping in the state of being at least partially within the switchback path, in a case that the controller determines that the recording medium is partially within the downstream path, the controller is configured to control the conveyance unit to carry out:

stopping the one recording medium such that the one recording medium is at least partially within the switchback path; and stopping the another recording medium such that the another recording medium is at least partially within the switchback path after the one recording medium is received by the receiving unit.

27. The recording apparatus according to claim 19, wherein the conveyance unit includes a spur roller to contact with the recording medium in the downstream path to convey the recording medium.

* * * * *